US005667182A

United States Patent [19]

Kribs

[11] Patent Number: 5,667,182

[45] Date of Patent: Sep. 16, 1997

[54] DEVICE TO HOLD READING MATERIAL

[76] Inventor: David E. Kribs, 368 Peninsular Ct., Haines City, Fla. 33844

[21] Appl. No.: 539,841

[22] Filed: Oct. 6, 1995

[51] Int. Cl.[6] ..... A47B 97/04

[52] U.S. Cl. ..... 248/448; 245/460; 245/447

[58] Field of Search ..... 248/447, 450, 248/460, 462, 463, 464, 166, 434, 436

[56] References Cited

U.S. PATENT DOCUMENTS

| | | | |
|---|---|---|---|
| 488,983 | 1/1893 | Byrkit | 248/447 |
| 1,051,047 | 1/1913 | Wood | 248/447 |
| 1,271,219 | 7/1918 | Pratt | 248/460 X |
| 4,948,082 | 8/1990 | Pagono | 248/460 |
| 4,998,703 | 3/1991 | Stewart | 248/447 |

FOREIGN PATENT DOCUMENTS

| | | | |
|---|---|---|---|
| 238002 | 8/1925 | United Kingdom | 248/460 |

*Primary Examiner*—Leslie A. Braun
*Assistant Examiner*—Kimberly T. Wood

[57] ABSTRACT

A device that sits on a flat surface, such as a table, desk, or counter top and the like to hold reading material such as newspapers, magazines, books, copy to be typed, sheet music, recipe cards, and the like in an upright position to save space on the table, desk, or counter top and to make the reading materials easy to read. This also keeps the hands of the user free for such activities as eating and writing. The device consists of a base piece which has on each end a rectangular notch into which fits a matching rectangular member. The rectangular members are hinged into the notches with dowels which allows the members to swivel, and two tines are inserted into each of the swiveling members. When the device is not in use the swiveling members swivel down and the tines in them swivel down, to lie flat on the base piece. This makes the device compact and easy to carry and store. When the device is in use, the swiveling members are swiveled up and the tines in them are swiveled up to accomodate reading material in an upright position. The device is made so the front side of the base, the side facing the user, is higher than the back side in order to slant the top of the reading material away from the user, which makes the material easy to read.

5 Claims, 2 Drawing Sheets

DEVICE TO HOLD READING MATERIAL

BACKGROUND OF THE INVENTION

1. Field of the Invention

The present invention relates to a device that sits on a flat surface such as a table, desk, or counter top to hold reading material, such as newspapers, books, magazines, copy to be typed, sheet music, recipe cards and the like in an upright position, with the top of the reading material slanting away from the user. When not in use the device folds down to the compact size of the base piece, which makes it small and easy to carry and store.

2. Description of Prior Art

Numerous patents have been granted for holding devices in the reading material field. U.S. Pat. No. 4,593,934 discloses a hand-held newspaper holder which has the stated primary purposes of preventing the transfer of newsprint and to release individual pages for facility of reading the newspaper. U.S. Pat. No. 4,466,639 reveals a holder for loose leaf sheets of material and thru the use of magnets secures the sheets in a temporary manner in the holder. U.S. Pat. No. 3,801,138 teaches a unit that sits on a frame on the floor and is comprised of a series of slats that are forced together by springs. The material being examined is inserted and held between the slats. U.S. Pat. No. 4,655,478 is a book support that has a pair of platens set in a V-shape that move toward and away from one another to accomodate books of different sizes and/or opened at different positions. U.S. Pat. No. 4,596,333 teaches a sheet holder for releasably restraining a stack of sheets of varying thickness so that operations such as writing can be performed on the top sheet. U.S. Pat. No. 4,886,231 discloses a portable bookstand with a retractable panel to hold a book in a slanted upright position. This portable bookstand cannot be folded in any way to make it smaller or more compact than the full size.

None of the above patents provide a device that can hold reading material in an upright position when in use and be folded down compactly for easy carrying and storage when not in use. The present invention is small enough when in the folded-down position to easily fit into a lady's purse or the glove compartment of a car, and takes up very little space on a table, desk, counter top or the like.

SUMMARY OF THE INVENTION

It is the object of this invention to provide a device that sits on a desk, table, counter top or the like that has swiveling tines that hold reading material, such as newspapers, books, magazines, copy to be typed, sheet music, recipe cards and the like in an upright position when in the "in use" position.

It is further an object of this invention that when the device is not in use the tines fold down onto the base piece, which makes the device compact and easy to carry and store.

It is further an object of this invention to make the base piece higher in the front, the part facing the user, than the back in order to make the base piece, and thus the top of the reading material in the fines slant away from the user. This slanting makes the material easy to read.

DESCRIPTION OF THE DRAWINGS

A detailed description of the preferred embodiment of the invention is hereinafter made to the drawing in which.

DESCRIPTION OF THE PREFERRED EMBODIMENT

Figure 1:
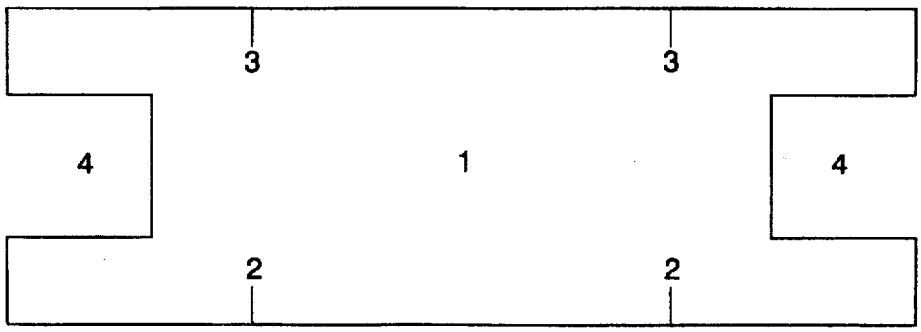
FIG. 1 is an overhead view of the base piece with the notches for the swiveling members cut into it.
Figure 2:
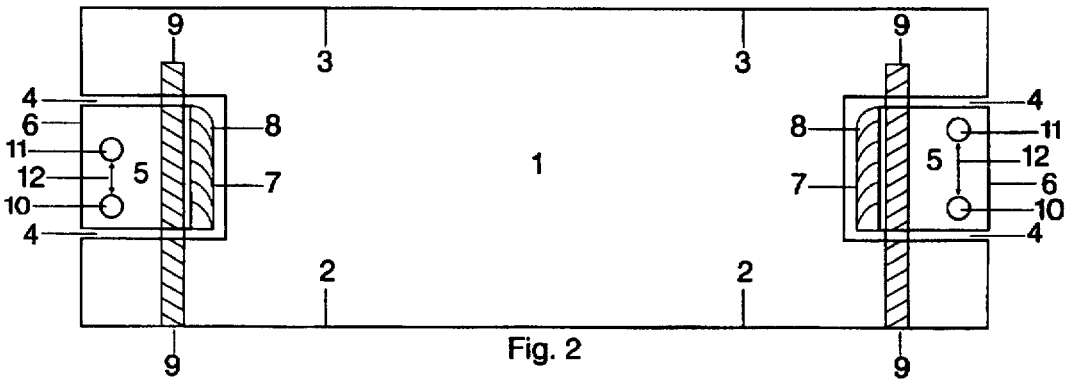
FIG. 2 is an overhead view of the invention with the tines in the upright, or in use, position ready to accomodate reading material.
Figure 3:
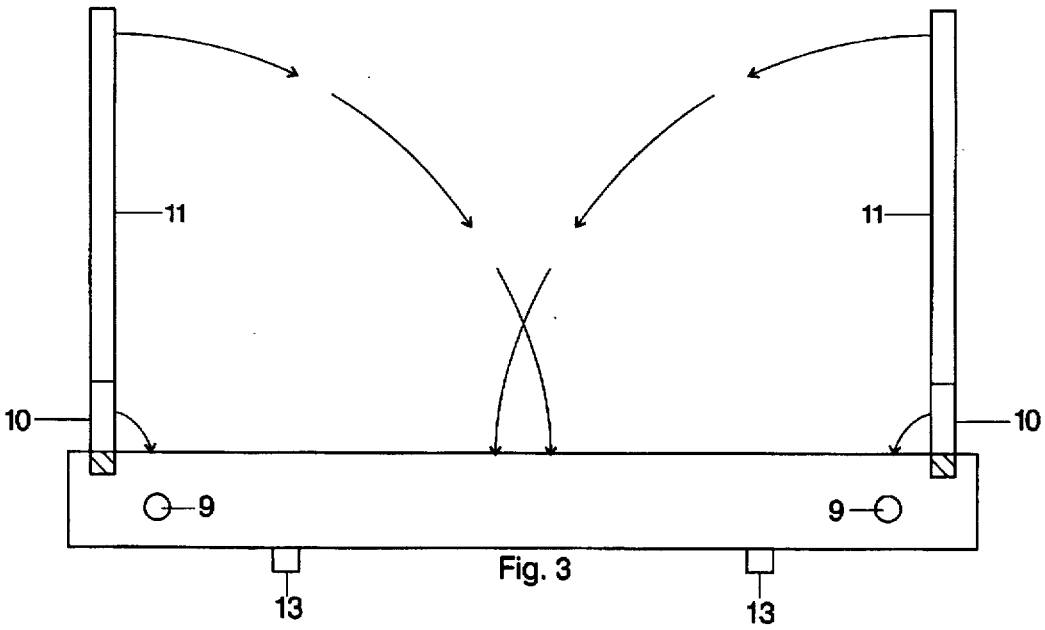
FIG. 3 is a frontal view of the invention with the tines in the upright, or in use, position ready to accommodate reading material.
Figure 4:
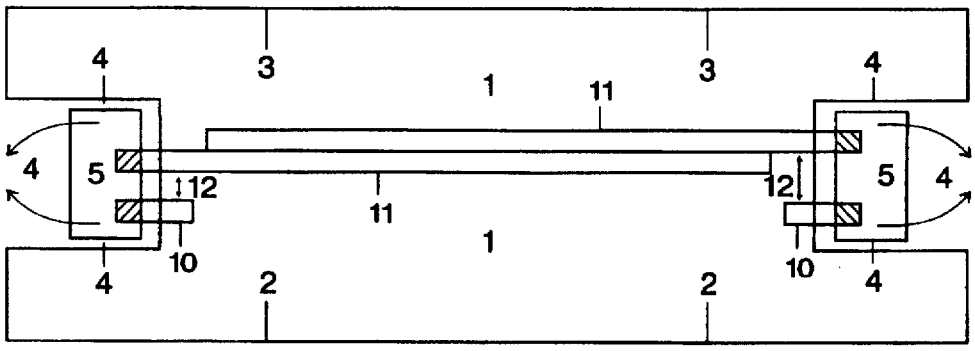
FIG. 4 is an overhead view of the invention with the tines in the closed, or folded down on the base position.
Figure 5:
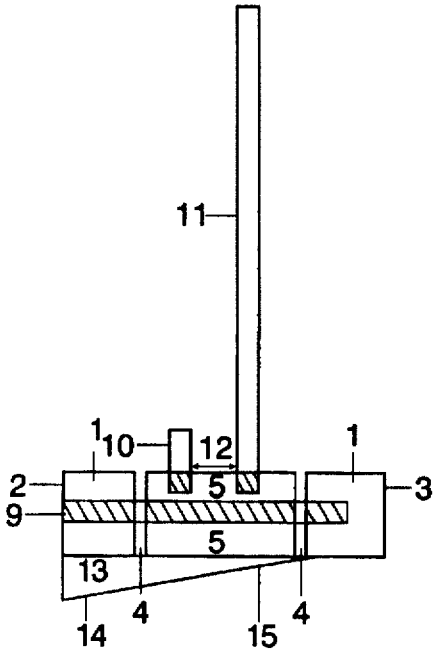
FIG. 5 is an end view of one end of the invention showing the tines in the upright, or in use position. The end shown in FIG. 5 is the end on which the tines in the swiveling member are close to each other.
Figure 6:
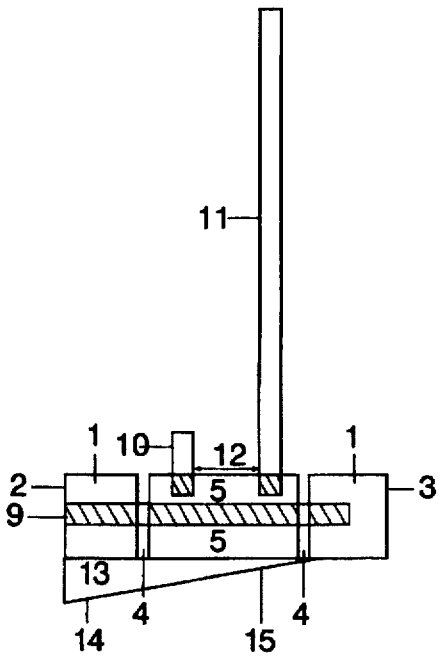
FIG. 6 in an end view of the opposite end of the invention shown in FIG. 5 above with the tines in the upright, or in use position. The end shown in FIG. 6 is the one on which the tines in the swiveling member are farther apart than in FIG. 5.

With reference now to the drawings, there is shown a device that sits on a flat surface, such as a table, desk, or counter top and the like and holds reading material, such as newspapers, magazines, books, copy to be typed, sheet music, recipe cards and the like in an upright position. As shown in FIGS. 1 thru 5 the base piece 1 has notches 4 cut into each end in which are held swiveling members 5 by means of dowels 9 as shown in FIGS. 2, 5, and 6. The dowels run into the front part of the base 2, into and thru the swiveling members 5 and into, but not thru the part of the part of the base piece that is toward the back 3 of the base piece. The inside edges 7, of the swiveling members 5 are beveled 8 as shown in FIGS. 2 and 3 to allow them to fold downward on to the base piece 1.

Tines 10 and 11 as shown in FIGS. 1 thru 6 are inserted into the swiveling members 5 near the outside edges 6 of the swiveling members. The front tines 10 extend upward only high enough to keep the held reading material from sliding off the base piece 1. The back tines 11 are long enough that when swiveled up they extend high enough to provide support to hold the held reading material in an upright position.

These back tines 11 are offset so that one is closer to the front 2 of the base piece 1 than to the back 3 of the base piece. This configuration allows them to be flat, side by side on the base piece 1 when folded into the down position.

It is in the space 12 between the tines 10 and 11 as shown in FIGS. 1 thru 6 that the reading material is placed and held in an upright position when the tines are swiveled to the upright position.

Affixed to the bottom of the base piece 1 at an equal distance from each end of the base piece 1 are wedges 13 as shown in FIGS. 3, 5, and 6. These wedges 13 can be attached to the base piece 1 by glue, screws, or other similar means. The thick, or high part of the wedges 13 are positioned on the front of the base piece 2 with the thin, or narrow part 15 of the wedges extending toward the back of the base piece 1. These wedges 13 tilt the invention away from the user, and when the reading material is inserted in the opening between the tines 12 the reading material also slants away from the user, making it easy to read.

Referring now to construction material of the present invention the base piece 1, the swiveling members 5, the dowels 9, the tines 10 and 11 and the wedges 13 may be constructed of wood, plastic, or any other suitable material.

With respect to the above description then, it is to be realized that the optional dimensional relationships for the parts of the invention, to include variation in size, shape, materials, form, assembly and use, are deemed readily apparent and obvious to one skilled in the art, and all equivalent relationships to those illustrated in the drawings and described in the specifications are intended to be encompassed by the present invention. Therefore, the foregoing is considered illustrative only of the principles of the invention, and accordingly all suitable modifications and equivalents that may be resorted to fall within the scope of this invention.

What is claimed to be new and different to be protected by Letters Patent of the United States is as follows:

1. A device adapted to hold reading material in an upright position, comprising:

a base having a top surface, a bottom surface, a front side, a back side and two opposing ends;

a notch cut out of each of the ends of said base;

a swiveling member held in a respective one of said notch at each of the ends of said base, said swiveling member having support means to hold reading material in said upright position;

dowels extending through said front side of said base, into and through a respective one of said swiveling members, and into but not through the back side of said base; and each of said swiveling members have beveled inside edges that allow said swiveling members to swing upward to an in use position and downward to a closed position.

2. A device as described in claim 1, wherein said support means includes short tines disposed on a front side of each of the swiveling members, said short tines preventing the reading material from sliding off said from side of said base when said swiveling members are swiveled up to said in use position.

3. A device as described in claim 2, wherein said support means further includes long tines disposed on a back side of each of said swiveling members, wherein the reading material rests on the long fines when said swiveling members are swiveled up to said in use position.

4. A device as described in claim 3, wherein said long tines are offset from one another such that one of the long tines are closer to said front side of said base than the other so that when the device is folded to said closed position, said long tines lie side by side on said base.

5. A device as described in claim 4, wherein said front side of the base is higher than said back side of the base.

* * * * *